United States Patent [19]

Cathell

[11] Patent Number: 4,501,567

[45] Date of Patent: Feb. 26, 1985

[54] ELONGATED WAND-TYPE WIND-UP AND TRIGGER-RELEASED SEPARABLE ACTUATOR FOR MOTORIZED TOY

[76] Inventor: Philip W. Cathell, 9340 Cardiff Loop Rd., Richmond, Va. 23235

[21] Appl. No.: 491,299

[22] Filed: May 3, 1983

[51] Int. Cl.[3] ..... A63H 29/00

[52] U.S. Cl. ..... 446/430; 446/462

[58] Field of Search ..... 446/429, 430, 450, 451, 446/462, 463, 464, 457, 459, 294

[56] References Cited

U.S. PATENT DOCUMENTS

| | | | |
|---|---|---|---|
| 2,605,585 | 8/1952 | Sebel | 446/294 |
| 2,608,027 | 8/1952 | Perker et al. . | |
| 2,704,416 | 3/1955 | Laird . | |
| 2,778,158 | 1/1957 | Ernst . | |
| 2,832,177 | 4/1958 | Mueller | 446/462 |
| 2,917,866 | 12/1959 | Ullmann . | |
| 3,064,389 | 11/1962 | Lemelson . | |
| 3,570,175 | 3/1971 | Angier . | |
| 3,665,643 | 5/1972 | Colgrove . | |
| 3,698,129 | 10/1972 | Lemelson . | |
| 3,701,216 | 10/1972 | Smith et al. . | |
| 3,757,459 | 9/1973 | Buck et al. . | |
| 3,803,756 | 4/1974 | Strongin . | |
| 3,826,039 | 7/1974 | Disko et al. . | |
| 3,919,804 | 11/1975 | Nakata . | |
| 3,932,957 | 1/1976 | Morrison et al. . | |
| 3,959,920 | 6/1976 | Ieda . | |
| 4,087,935 | 5/1978 | Edmisson et al. . | |
| 4,116,084 | 9/1978 | Masuda . | |
| 4,130,963 | 12/1978 | Ohashi . | |
| 4,135,328 | 1/1979 | Yamasaki . | |
| 4,141,256 | 2/1979 | Wilson et al. . | |
| 4,193,223 | 3/1980 | D'Andrade et al. . | |
| 4,283,879 | 8/1981 | Tsui . | |
| 4,324,063 | 4/1982 | Rosenwinkel et al. . | |
| 4,406,084 | 9/1983 | D'Andrade | 446/459 |

*Primary Examiner*—F. Barry Shay

*Attorney, Agent, or Firm*—Cushman, Darby & Cushman

[57] ABSTRACT

For use in conjunction with a toy of the kind that includes a body having a motor of the flywheel/friction motor type, or of the wind-up spring motor type, a powering-up and releasing device is provided. This device includes an elongated wand which the user temporarily connects to the toy, may use to wind the toy up where the toy has a spring motor, and then uses to release the powered-up toy, by pushing a button, trigger or the like. This actuator is especially useful where the toy is a model race car or other wheeled toy meant to scoot along the floor or ground or along a track.

8 Claims, 2 Drawing Figures

ELONGATED WAND-TYPE WIND-UP AND TRIGGER-RELEASED SEPARABLE ACTUATOR FOR MOTORIZED TOY

BACKGROUND OF THE INVENTION

Many child's toys are provided with wind-up spring motors, or flywheel/friction motors which are actuated by repeatedly rapidly rolling the wheels of the toy against the floor, then letting go of the toy. Especially for those of these types of toys as are intended to roll along the ground rather than to fly through the air, powering-up the toy and letting it go requires that the child position himself or herself in close proximity to the surface on which the toy is to be released. Sometimes the child is tempted, then, to play on a table top, with the attendant possibilities that the table top may be dirtied, scuffed or scratched, and that the toy may fall off the edge and break. Or the child may get right down on the floor or on the ground, with the result that his or her clothes become dirty or torn as the child moves about on the floor or ground while absorbed in powering-up the toy, releasing it and retrieving it.

SUMMARY OF THE INVENTION

For use in conjunction with a toy of the kind that includes a body having a motor of the flywheel/friction motor type, or of the wind-up spring motor type, a powering-up and releasing device is provided. This device includes an elongated wand which the user temporarily connects to the toy, may use to wind the toy up where the toy has a spring motor, and then uses to release the powered-up toy, by pushing a button, trigger or the like. This actuator is especially useful where the toy is a model race car or other wheeled toy meant to scoot along the floor or ground or along a track.

The principles of the invention will be further discussed with reference to the drawing wherein a preferred embodiment is shown. The specifics illustrated in the drawing are intended to exemplify, rather than limit, aspects of the invention as defined in the claims.

DETAILED DESCRIPTION

Figures 1, 2:
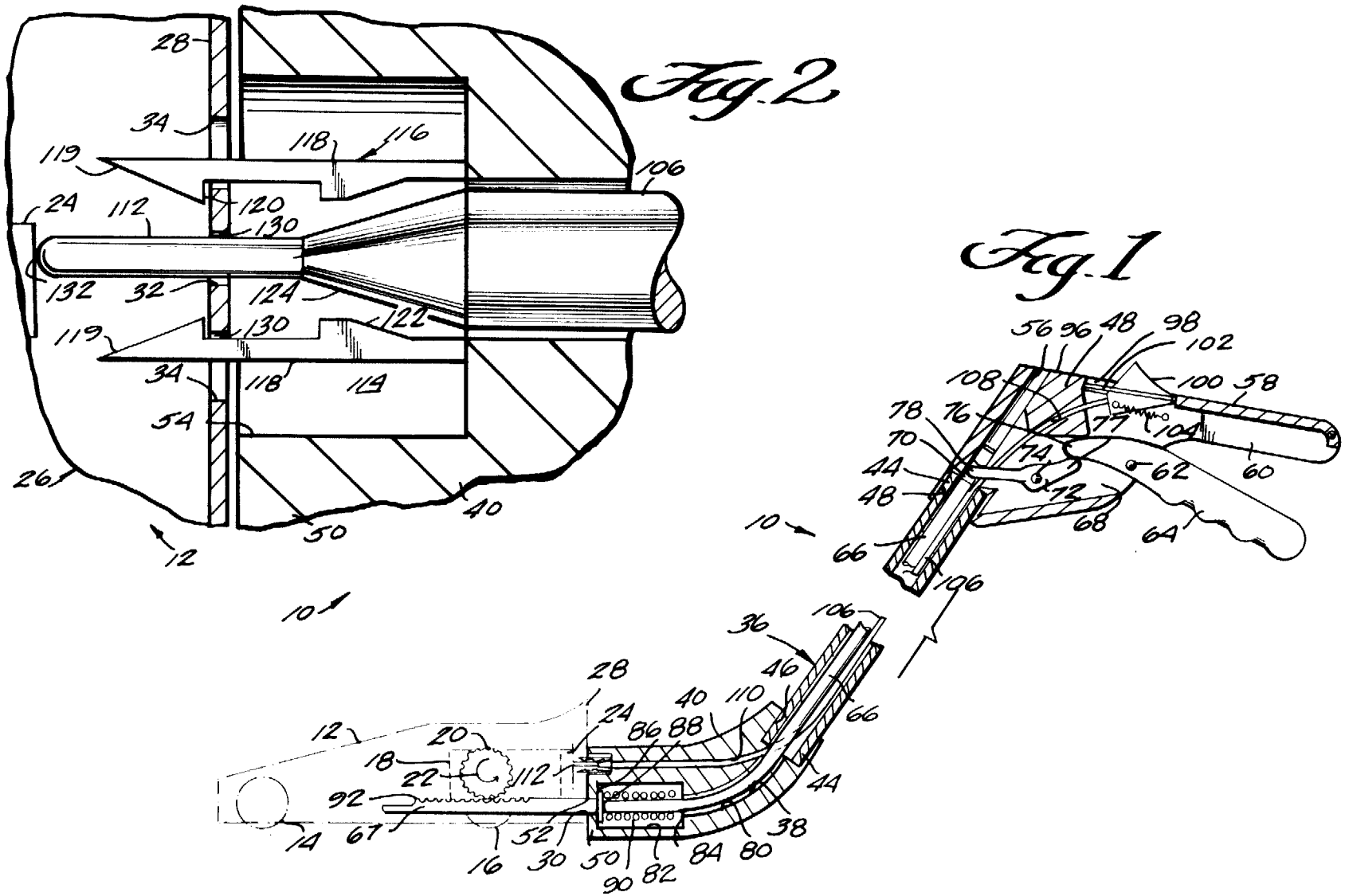
FIG. 1 is a longitudinal sectional view of the device of the invention connected in actuating relation to a toy racing car.
FIG. 2 is a fragmentary longitudinal sectional view on a larger scale illustrating how the rack pull rod housing is held fixed to the toy until the activator rod is thrust forwards to simultaneously activate the wound mechanical motor of the car and separate the car from the rack pull rod housing.

As an example of a mechanical motored toy which may be operated using the actuator 10 of the present invention, there is shown a wheeled race car 12 having free wheels 14, powered wheels 16 and a motor 18, which may be for instance, a spring motor or a conventional friction/flywheel type of mechanical motor. The toy 12 and its motor 18 may be utterly conventional. To that end, the motor 18 is provided with a ratchet-type of wind-up device, e.g. a gear 20 which, when rotated in one direction, e.g. in the direction of the arrow 22, winds-up the motor 18, which continues to be receptive to being further wound-up and not to run, until a conventional trigger 24 is actuated, e.g. by being pressed longitudinally forwards.

The race car 12 is shown having a body 26 with a rear end wall 28 that is provided with a power rack insertion slot 30, a motor activator plunger insertion slot 32 and a plurality, e.g. a pair of locking jaw insertion slots 34 spacedly flanking the motor activator plunger insertion slot 32.

The actuator 10 may be thought of as being an elongated, wand-type wind-up and trigger-released actuator for the motorized toy 12.

To that end the actuator 10 typically includes an elongated tubular housing 36 which is at least a couple of inches long and which, indeed, may be two, three, four or several feet long. The housing 36 preferably is straight, but it may be serpentine or simply arcuate or the like, generally so as to have a lower forward end and an upper rear end. The housing 36 has at least one throughbore 38. It may have a second one parallel to the first, or simply a common throughbore for the two elements which are to pass along the length of the housing 36. The lower/front end of the tubular housing 36 is shown provided with a fitting in the form of a rack pull rod housing 40 and the upper/rear end of the tubular housing 36 is shown provided with a fitting in the form of a handle housing 42.

Conceivably in some instances, the structure 36, 40, 42 could be molded of synthetic plastic resin or otherwise integrally formed as a unit. Preferably, however, the tubular portion 36 is separately formed, e.g. of extruded tubing, and the two terminal portions 40, 42 are molded, e.g. injection molded all of conventional plastics materials, and by conventional extruding and molding techniques. Polystyrene, polyvinylchloride and polyethylene are typical materials. When the structure 36, 40, 42 is made in three pieces, these may be united by jam fitting of the ends 44 of the housing 36 into respective sockets 46, 48 in the parts 40, 42, with or without the aid of adhesive securement, solvent welding, ultrasonic welding, spin-welding or the like, conventionally employed. Accordingly, there is provided a unitary actuator housing structure including a tubular central portion 36 with a head end 40 and a tail end 42.

The forward end 50 of the rack pull rod housing 40 is shown shaped to engage the rear end wall 28 of the body 26 of the toy 12 at least in the vicinity of the motor activator insertion slot 32. Further, the forward end 50 of the rack pull rod housing 40 is shown provided with a rack pull rod opening 52 and a motor activator rod opening 54.

The handle housing 42 is shown including a longitudinal bore 56 continuing axially from the upper end of the socket 48, and a rearwardly-extending stationary handle portion 58. The housing 42 is hollowed at 60 under the stationary handle portion to provide for the pivotal mounting at 62 of a squeezable grip-type movable handle portion in the nature of a drive lever 64.

A rack pull rod 66 which may be formed of flexible resilient metal or plastic is shown longitudinally reciprocably received in the bore 38 in the actuator 10. The rack pull rod 66 has an exposed forward portion 67 which projects forwardly beyond the surface 50, out of the rack pull rod opening 52. With in the handle housing 42, the upper, read end portion of the rack pull rod 66 is longitudinally reciprocably received in the longitudinal bore 56.

Within the hollow 60 of the handle housing 42 a rearwardly oriented opening 68 provides lateral access to the longitudinal bore 56. At this same level, a slot, notch, tab or the like 70 is shown provided on the rack pull rod 66, near the rear, upper extent of the latter. A toggle lever 72 is shown pivotally mounted at 74 in the hollow 60 of the handle housing 42 so as to have one toggle arm 77 engaged under a protuberance 76 of the drive lever 64 and an opposite toggle arm 78 engaged with the rack pull rod feature 70.

Down close to the opening 52, the rack pull rod housing bore 80 is provided with an enlarged compartment 82 through which rack pull rod 66 coaxially longitudinally passes. This compartment has an annular rear wall 84 and opposite that, an annular front wall 86. An annular collar 88 fixed on the rod 66 and disposed within the compartment 82 limits longitudinal projection of the rack pull rod 66 by engagement with the front wall 86. A compression coil spring 90 is received in the compartment 82 coaxially surrounding the rod 66, with its forward end pressing against the rear of the collar 88 and its rear end pressing against the annular rear end wall 84 of the compartment 82. Accordingly, the spring 90 normally keeps the rack pull rod fully projected. However, if the user grips the handle stationary portion 58 and the drive lever 64 and squeezes, the drive lever is temporarily pivoted up to adjacency with the underside of the portion 58. This pushes down the rear arm 77 of the toggle lever 72, correspondingly pushes up the forward arm 78 of the toggle lever 72, causing the rack pull rod to be correspondingly longitudinally reciprocated upwards in a sense which partially retracts the exposed forward portion 67 of the rack pull rod 66. As the user lets-up on his or her squeezing action, the spring 90 which has become compressed, recovers, and in doing so again fully projects the rack pull rod exposed forward portion 67 and returns the drive lever 64 to the full-line position shown.

The user may repeatedly perform this squeezing maneuver, each squeeze resulting in a correspondingly rapid retraction and projection of the rack pull rod exposed forward portion 67.

It should now be noticed that the rack pull rod 66 exposed forward portion 67 is provided with a longitudinally extending series of rack gear teeth 92. This series 92 of the rack gear teeth is constructed and arranged to drivingly mesh with the ratcheted wind-up gear 20 for the motor 18 of the toy 12. Accordingly, when the rack gear 67 is inserted through the insertion slot 30 and engaged with the gear 20, provided the actuator 10 is fixed to the toy 12, each time the drive lever 64 is squeezed, the rack gear turns the gear 20 to correspondingly wind the motor 18. Each time the drive lever 64 is released, the spring 90 projects the rack gear, spinning the ratcheted gear 20 without affecting the motor 18.

The remainder of the actuator 10 has to do with a means for releasably holding the actuator 10 secured to the toy 12, and for simultaneously releasing the actuator 10 from the toy and pushing the trigger 24 of the wound-up motor 18.

To these ends, the upper side 96 of the stationary portion of the handle is shown provided toward the front with a slot 98 through which there upwardly projects a drive actuator slide button 100. The slide button 100 is shown mounted with the aid of an interdigitated slot and groove arrangement 102 which permits the slide button 100 to be slid forward in the slot 98. Within the hollow of the handle housing a tension coil spring 104 is shown anchored at one end and secured at the other to the slide button 100 for pulling the slide button back to the full line position shown after the slide button has been pushed forward and released.

Also within the actuator housing a flexible motor activator rod or wire 106 is shown secured at one end to the slide button 100, longitudinally slidably supported in passageways 108, 110, and having a forward end portion 112 which projects out of the actuator housing through the motor activator rod opening 54. Accordingly, as the slide button 100 is pushed forwards and released, the motor activator rod 106 is correspondingly reciprocated longitudinally forwards to greater protraction, then retracted to the full line position shown. (As indicated hereinabove, that amount of forward projection is sufficient to release the conventional trigger 24 of the wound-up conventional spring motor or friction/flywheel motor 18.)

With particular attention to FIG. 2, it should be noted that the rack pull rod housing is coaxially provided about the motor activator rod opening 54 with an annular groove 114 which defines a spring finger collet structure 116 perimetrically surrounding the opening 54. A plurality of respective slots split the structure 116 into a respective plurality of individual resilient fingers 118, each based on the rack pull rod housing and normally disposed to have the respective positions shown in full lines in FIG. 2.

Each finger 116 is provided on its outer end with a tapered internal surface 119 which converges, barb-fashion to an abrupt shoulder 120 which faces the housing interior from a location somewhat beyond the level of the rack pull rod housing forward end surface 50. Within the housing, each finger is provided with a tapered ramp surface 122 which decreases in diameter toward the forward end surface 50.

The activator rod 106 is, centrally among the ramps 122, provided with a complementarily tapered surface 124 which usually lies radially inwardly and longitudinally upstream from the ramp surfaces 122.

The actuator 10 is used in association with the car by simply urging the toy body rear wall 28 into confronting relation with the front end wall of the actuator 10. As these two units are urged together, the rack gear 67 of the rack pull rod enters the corresponding opening of the toy and its teeth 92 become drivingly engaged with the ratcheted wind-up gear 20 of the motor 18, and the forward end of the motor activator rod enters the corresponding opening of the toy and becomes poised in juxtaposition with the release trigger 24 of the motor 18. Finally, during the performance of this docking procedure, the tapered surfaces 118 on the actuator engage the slot edge surfaces 130 on the car and the outer ends of the fingers 116 are thereby resiliently deflected until the shoulders 120 enter and latch behind the wall 28. The toy and the actuator now are locked together.

The user may then wind or otherwise mechanically power-up the toy motor as much as is desired, by squeezing the handle of the actuator one or a succession of times as is described hereinabove. When the user wishes the toy to be released and begin operation, the user simply pushes the slide button 100 forwards momentarily. As the motor activator rod 106 is thereby advanced, two events are nearly simultaneously caused to occur. The forward end 132 of the activator rod triggers the catch on the wound motor 18 so that the motor begins to wind-down, e.g. powering the toys's driving wheels, and the surface 124 on the activator rod engages the ramp surfaces 122 on the spring fingers 116, causing the spring fingers 116 to be resiliently deflected radially outwards sufficiently to release the catches at 120, 130, so that the toy separates from the actuator and speeds away.

The actuator is ready and available for immediate reuse with the same toy or one having like powering, coupling and release provisions.

It should now be apparent that the elongated wand-type wind-up and trigger-released separable actuator for motorized toy as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For use in conjunction with a toy of the kind which includes a body having a mechanically wound-up motor for mechanically powering the toy, including a wind-up means constructed and arranged to be rotated in one direction for storing mechanical energy in the motor, and a releasable catch for preventing the motor from beginning to wind-down until the catch is triggered for release, an elongated wand-type wind-up and trigger-released separable actuator, comprising:

an elongated housing having a forward end portion and a rear end portion which are substantially separated by an intermediate elongated portion;

an elongated rack pull rod longitudinally slidably mounted to said elongated housing and having a forward end portion projecting forwardly from said forward end portion of said elongated housing;

lever means mounted on said rear end portion of said elongated housing and including means operatively connecting with said lever means with said elongated rack pull rod, so that as the lever means is manipulated the elongated rack pull rod is longitudinally reciprocated in a sense to partially retract the projecting forward end portion of said elongated rack pull rod into said elongated housing;

return means for returning said lever means and elongated rack pull rod following such manipulation;

said projecting forward end portion of said elongated rack pull rod having a series of rack teeth provided thereon which constitute a rack constructed and arranged to operatively, meshingly engage with said wind-up means of said mechanically wound-up motor of said toy;

an elongated drive activator rod longitudinally slidably mounted to said elongated housing and having a forward end portion projecting forwardly from said forward end portion of said elongated housing;

button means mounted on said rear end portion of said elongated housing and including means operatively connecting said button means with said elongated drive activator rod, so that as the button means is manipulated the elongated drive activator rod is longitudinally reciprocated in a sense to longitudinally move the projecting forward end portion of said elongated drive activator rod;

return means for returning said button means and said elongated drive activator rod following such manipulation;

said projecting forward end portion of said elongated drive activator rod including catch releasing end surface means provided thereon and being constructed and arranged to engage and releasingly trigger said releasable catch; and means on said forward end portion of said elongated housing for releasably locking said elongated wand-type actuator to said toy body.

2. The elongated wand-type actuator of claim 1, wherein:

said releasable locking means is mechanically coupled with said elongated drive activator rod, so that said button means is manipulated to longitudinally reciprocate said elongated drive activator rod in said sense, said elongated wand-type actuator is released from said toy body substantially simultaneously with triggering of said releasable catch of said motor.

3. The elongated wand-type actuator of claim 2, wherein:

said intermediate elongated portion of said elongated housing is on the order of two inches to four feet in length.

4. The elongated wand-type actuator of claim 2, wherein:

said intermediate elongated portion of said elongated housing projects upwardly and rearwardly from said forward end portion and said rear end portion extends rearwardly from said intermediate elongated portion.

5. The elongated wand-type actuator of claim 2, wherein:

said means for releasably locking said elongated wand-type actuator to said toy body include a plurality of catch-including spring fingers mounted to the forward end portion of said elongated housing so as to project forwardly therefrom perimetrically of said projecting portion of said elongated drive activator rod; and cam means on said elongated drive activator rod for laterally flexing said spring fingers.

6. The elongated wand-type actuator of claim 2, wherein:

said rear end portion of said elongated housing includes a stationary handle portion, said lever means being squeezable to said handle for manipulation of said lever.

7. In combination:

a toy of the kind which includes a body having a mechanically wound-up motor for mechanically powering the toy, including a wind-up means constructed and arranged to be rotated in one direction for storing mechanical energy in the motor, and a releasable catch for preventing the motor from beginning to wind-down until the catch is triggered for release; and an elongated wand-type wind-up and trigger-released separable actuator, comprising:

an elongated housing having a forward end portion and a rear end portion which are substantially separated by an intermediate elongated portion;

an elongated rack pull rod longitudinally slidably mounted to said elongated housing and having a forward end portion projecting forwardly from said forward end portion of said elongated housing;

lever means mounted on said rear end portion of said elongated housing and including means operatively connecting with said lever means with said elongated rack pull rod, so that as the lever means is manipulated the elongated rack pull rod is longitudinally reciprocated in a sense to partially retract the projecting forward end portion of said elongated rack pull rod into said elongated housing;

return means for returning said lever means and elongated rack pull rod following such manipulation;

said projecting forward end portion of said elongated rack pull rod having a series of rack teeth provided thereon which constitute a rack constructed and arranged to operatively, meshingly engage with said wind-up means of said mechanically wound-up motor of said toy;

an elongated drive activator rod longitudinally slidably mounted to said elongated housing and having a forward end portion projecting forwardly from said forward end portion of said elongated housing;

button means mounted on said rear end portion of said elongated housing and including means operatively connecting said button means with said elongated drive activator rod, so that as the button means is manipulated the elongated drive activator rod is longitudinally reciprocated in a sense to longitudinally move the projecting forward end portion of said elongated drive activator rod;

return means for returning said button means and said elongated drive activator rod following such manipulation;

said projecting forward end portion of said elongated drive activator rod including catch releasing end surface means provided thereon and being constructed and arranged to engage and releasingly trigger said releasable catch; and means on said forward end portion of said elongated housing for releasably locking said elongated wand-type actuator to said toy body.

8. The combination of claim 7, wherein:

said releasable locking mean is mechanically coupled with said elongated drive activator rod, so that said button means is manipulated to longitudinally reciprocate said elongated drive activator rod in said sense, said elongated wand-type actuator is released from said toy body substantially simultaneously with triggering of said releasable catch of said motor.

* * * * *